United States Patent [19]

Crowley et al.

[11] Patent Number: 4,808,079

[45] Date of Patent: Feb. 28, 1989

[54] MAGNETIC PUMP FOR FERROFLUIDS

[76] Inventors: Christopher J. Crowley, R.F.D. Box 224, Lyme, N.H. 03768; W. Dodd Stacy, R.F.D. 2, South Royalton, Vt. 05068

[21] Appl. No.: 59,402

[22] Filed: Jun. 8, 1987

[51] Int. Cl.[4] ..... E04B 15/02

[52] U.S. Cl. ..... 417/50; 310/11

[58] Field of Search ..... 417/50; 310/11

[56] References Cited

U.S. PATENT DOCUMENTS

| | | | |
|---|---|---|---|
| 3,187,672 | 6/1965 | Baker | 417/50 |
| 3,372,644 | 3/1968 | Nilson | 417/50 |
| 3,505,644 | 3/1985 | Meisner et al. | 417/50 |
| 4,050,851 | 9/1977 | Haavik | 417/68 |

FOREIGN PATENT DOCUMENTS

| | | | |
|---|---|---|---|
| 50083111 | 1/1977 | Japan | 417/50 |

OTHER PUBLICATIONS

Tae in Choi Thesis, University of Florida, "Ferro Fluid Motion in a Rotating Magnetic Field", 1980.

Daniel H. Braymer and A. C. Roe, "Repair Shop Diagrams and Connecting Tables for Lap-Wound Induction Motors", McGraw-Hill Book Company, 1946.

O. A. Glazov, Entrainment of a Ferromagnetic Suspension by a Traveling Magnetic Field, Magnetohydrodynamics Jul.-Sep. 1973, pp. 395-396.

O. A. Glazov Role of Higher Harmonics in Ferrosuspension Motion in a Rotating Magnetic Field, "Magnetohydrodynamics" Oct.-Dec. 1975, pp. 434-438.

O. A. Glazov, Setting a Ferromagnetic Liquid into Motion with a Running Magnetic Field, "Magnetohydrodynamics" Oct.-Dec. 1976, pp. 400-404.

*Primary Examiner*—Carlton R. Croyle

*Assistant Examiner*—Eugene L. Szczecina

*Attorney, Agent, or Firm*—Janine J. Weins; Michael J. Weins

[57] ABSTRACT

The present invention is directed to a magnetic pump for pumping ferrofluids. The magnetic pump in its simplest form has at least two coils which are electrically connected to a multi-phase power source to produce a traveling electromagnetic field. In close proximity to the coils and substantially normal to the axis of the coils is a tube which defines the path of fluid flow. It is preferred that the coils be embedded in a stator of ferromagnetic material and that the stator be cylindrical. Preferably the tube is wound about the cylindrical stator either internal to or external to the stator. In a preferred embodiment of the present invention the tube is placed in an annular gap between cylindrical stators of different diameter and having coils energized so as to produce reinforcing traveling magentic fields.

5 Claims, 2 Drawing Sheets

MAGNETIC PUMP FOR FERROFLUIDS

FIELD OF INVENTION

This invention relates to a magnetic pump for pumping ferrofluids.

BACKGROUND

Ferrofluids are liquids in which ferromagnetic particles are suspended. Ferrofluids are currently pumped using conventional mechanical fluid pumps. These conventional pumps permit only limited control of the flow rate and allow the fluid to be pumped in only one direction. In addition, conventional pumps have moving pump components located in the path of fluid thus it may be necessary to penetrate the fluid boundary during repair. Penetration of the fluid boundary may be impractical if the pump is in a zero gravity environment, such as space, or when the fluid is contaminated such as when the pump is used in nuclear applications.

Mechanical pumps are not well suited for pumping fluids having both liquid and gas phases, since the pressure head developed by the pump drops to zero at small volume fractions of vapor.

Experiments have shown that ferrofluids can be set in motion by a magnetic field. In particular, the thesis of Tae In Choi entitled: "Ferro Fluid Motion in a Rotating Magnetic Field", University of Florida, 1980, noted that magnetic fields caused ferrofluids contained in a vessel to circulate in one direction towards the center of the vessel and in the opposite direction near the outer portion of the vessel.

A series of articles written by O.A. Glazov discuss the theory of the use of a moving magnetic field to set in motion magnetic fluids. These articles are: Entrainment Of a Ferromagnetic Suspension By a Traveling Magnetic FIELD; "Magnetohydrodynamics" July--Sept. 1973, p.p. 395-396; Role OF Higher Harmonics In Ferrosuspension Motion In a Rotating MAGNETIC FIELD "Magnetohydrodynamics" Oct-Dec. 1975, p.p. 434-438; and Setting a Ferromagnetic Liquid INTO Motion With a Running Magnetic FIELD "Magnetohydrodynamics" Oct-Dec. 1976 p.p. 400-404 O.A. Glazov.

Theoretical calculations have shown that a magnetic particle and a magnetic liquid can be moved in a manetic field. The rotation of a body of ferrofluid has been achieved by the use of a rotating magnetic field. The likelihood that using a moving magnetic field could cause flow of a ferrofluid in a flow channel such as a tube has not been established. Therefore, although it appears likely that a moving magnetic field could effect the movement of a body of fluid containing magnetic particles, the utility of such a concept is uncertain.

Some ferrofluids have properties which make them suitable for use as heat transfer fluids, thus a magnetic pump, if practical, could be used in heat transfer applications.

There is no teaching in the prior art which predicts the characteristics of the electric field needed to move a ferrofluid in a flow channel, the design of a pump employing such a concept, and the operating conditions of such a pump.

There is a need for a pump that could utilize a magnetic field to produce motion in ferrofluids so as to produce a pumping of the fluids.

SUMMARY OF THE INVENTION

It is an object of the invention to provide a pump which cam pump ferrofluids using a traveling electro magnetic wave.

It is an object of the invention to provide a pump for pumping ferrofluids which does not have moving pump components.

It is another object of the invention to provide a pump capable of pumping a mixture of liquid ferrofluid and vapor.

It is another object of the invention to provide a pump for ferrofluids which will allow the direction of flow to be reversed.

Still another object of the invention is to produce a pump having no moving parts in the fluid path.

It is another object of the invention to provide a pump for ferrofluids which can be serviced without exposing the ferrofluids.

It is an object of the present invention to provide a pump which can be used in a zero gravity environment.

It is another object of the invention to provide a pump for pumping ferrofluids adjustable flow rate.

These and other objects of the present invention will become apparent from the following figures and description.

The magnetic pump of the present invention in its simplest form has at least two coils which are electrically connected to a multi-phase power source. The connection being such as to produce a traveling magnetic field. In close proximity to the coils is a tube for transporting the ferrofluid.

It is preferred that the coils be embedded in a stator of ferromagnetic material and that the stator be cylindrical. If a cylindrical stator is used it is preferred that the tube is wound about the stator either internal or external to the stator.

It is further preferred that the tube be placed in the annular space between two cylindrical stators having different diameters which have coils wound therein and are energized so as to produce reinforcing traveling magnetic fields.

In another preferred embodiment only one of two cylindrical stators have coils which are energized.

BEST MODE FOR CARRYING THE INVENTION INTO PRACTICE

Figure 1:
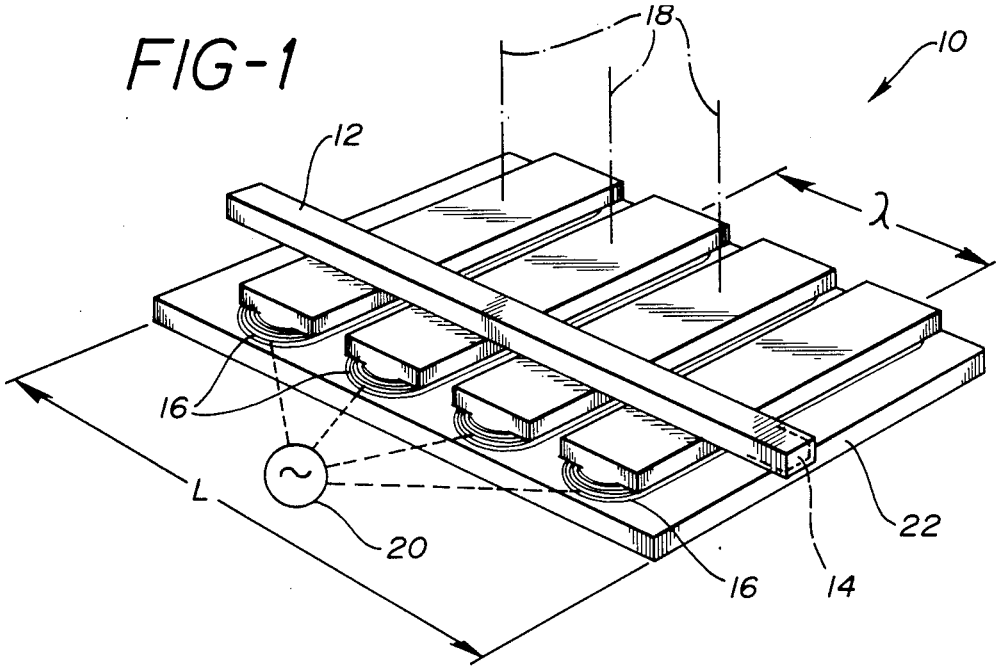
FIG. 1 is a schematic representation of one embodiment of the present invention.

FIG. 1 illustrates one embodiment of the magnetic pump 10 of the present invention. The pump 10 in its simplest form has a tube or closed channel 12 which confines the ferrofluid 14. A tube having a rectangular cross section is preferred. The tube 12 is placed in close proximity to electrical coils 16 and is substantially normal to the axes 18 of the coils 16. The coils are arranged in groups.

The coils 16 are connected to a multiphase power source 20 in such a manner as to produce a traveling magnetic field. Such a traveling magnetic field is further discussed by A. O. Glazov in the articles cited in the Background Art.

Three phase power sources are the most commonly used multiphase power sources. Techniques for coil winding were developed with respect to motors and generators, these same techniques can be used to wind coils to produce traveling magnetic fields. In general, two and three phase power sources are used since they interface with standard coil winding technology which is summarized in the book by Daniel H. Braymen and A.C. Roe, entitled "Repair-Shop Diagrams AND Connecting Tables FOR Lap-Wound Induction Motors."

A power source 20 is employed to energize the coils 16. The coils 16 may be energized in a sequential manner or in a pair wise manner. The repeat pattern for the pair wise sequence will be λ as shown in FIG. 1.

In order to assist in developing a uniform magnetic field with respect to the tube 12 it is preferred that the coils 16 are embedded in a ferromagnetic body or stator 22. The stator 22 is preferably of a laminated construction to reduce eddy current losses such laminated construction is standard in the stators of electric motors.

For maximum pumping efficiency it is preferred that the tube diameter be between:

$$\frac{0.5\lambda}{2\pi} \leqq d \leqq \frac{\lambda}{2\pi}$$

where λ is the pole repeat length; and d is the diameter of the tube.

It is further preferred that the tube cross section be rectangular rather than round. A rectangular cross section increases the quantity of ferrofluid 14 in the field of the coils 16.

Figure 2:
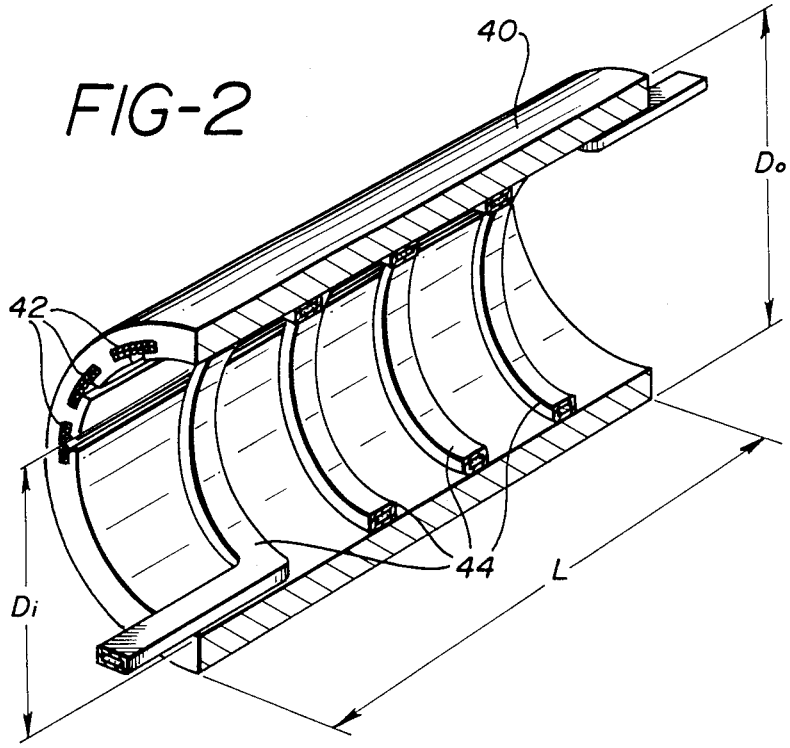
FIG. 2 is a schematic representation of a second embodiment of the present invention where the coils are embedded in a cylindrical stator and the tube carrying the ferrofluid is helical and surrounded by the stator.

For a magnetic pump having a configuration such as shown in FIG. 1 the pressure drop will be a function of the length of the stator 22. For this reason it is preferred that the coils be arranged in a cylindrical configuration such as illustrated in FIG. 2. With such a configuration the stator 22 can be a conventional stator from a induction motor.

FIG. 2 shows an embodiment of the present invention in which the stator 40 is a cylindrical shell having an external diameater Do, an inner diameter Di and a length L. Coils 42 are embedded in the stator 40. A tube 44 is wound in a helix with an outer radius to accommodate the cylindrical cavity of the stator 40. A square tube is preferred since the square cross section allows maximum ferrofluid to be in the field per unit of cross section, while allowing the maximum turns per unit length of the stator. While the tube 44 is shown in FIG. 2 is wound internal to the stator alternatively the tube 44 could be wound external to the cylindrical stator 40.

Figure 3:
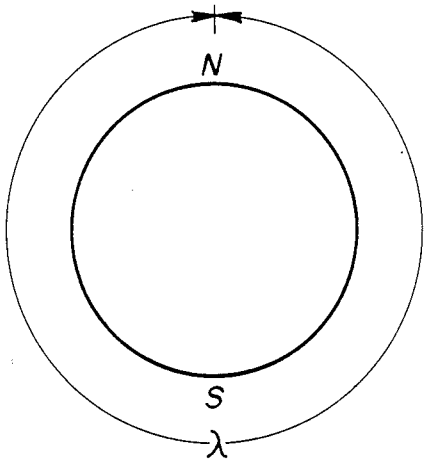
FIG. 3 is a schematic representation of the repeat pattern of a two pole cylindrical stator.
Figure 4:
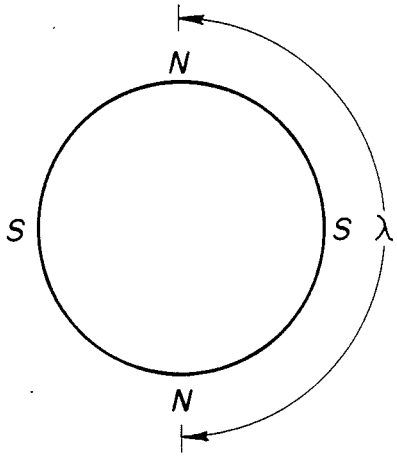
FIG. 4 is a schematic representation of the repeat pattern of a four pole cylindrical stator.

The winding of the stator 40 can be varied to produce multiple pole configurations such as the two pole configuration of FIG. 3 or the four pole configuration of FIG. 4. The winding sequence for various pole configurations is taught in the book of Braymen and Roe referenced above and incorporated herein by reference.

Figure 5:
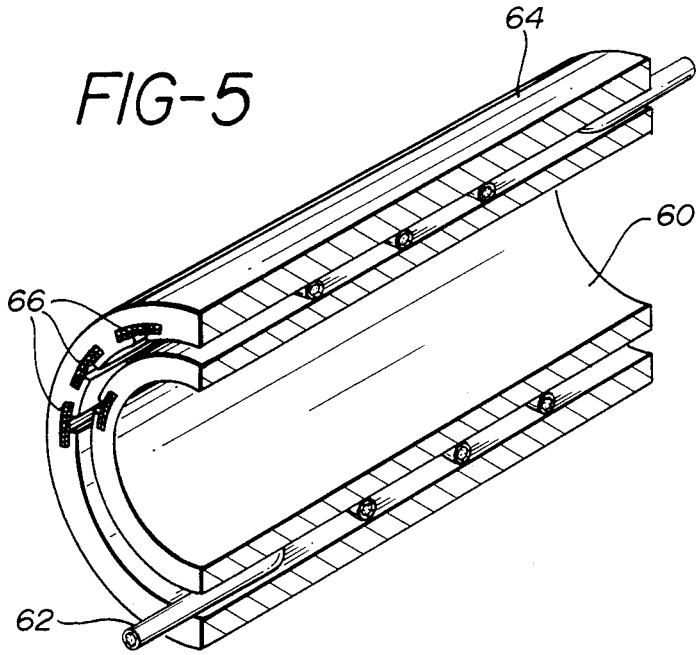
FIG. 5 is a schematic representation of a third embodiment of the present invention in which the tube transporting the ferrofluid is positioned between two spaced apart cylindrical stators.

The efficiency of the pump shown in FIG. 2 can be improved by adding an additional stator. FIG. 5 shows an internal stator 60 within a helical tube 62 with diameter d wound external thereto. The helical tube 62 is positioned between an internal stator 60 and an external stator 64. Both the internal stator 60 and the external stator 64 are made of a ferromagnetic material. Either or both of the stators may contain coils 66. Preferably the coils 66 are embedded in both the internal stator 60 and the external stator 64. The stators are wound to produce traveling magnetic fields having the same wave form. The interior stator 60 is rotatably mounted with respect to the external stator 64. The stators are positioned relative to each other so that the traveling magnetic field of the internal stator 60 reinforces the magnitude of the magnetic field of the external stator 66.

When a cylindrical stator is used it is preferred that L/D ratio be at least 1. Such a configuration will assure uniformity of field and a constant pumping force on the ferrofluid.

While the present invention has been described in terms of preferred embodiments and particular methods substitution by one skilled in the art can be made without departing from the spirit of the invention.

What we claim is:

1. A pump for a ferrofluid comprising:

at least a first group of coil elements forming at least two coils of electrical conductors, said coils being arranged in a cylindrical configuration;

a first ferromagnetic cylindrical stator having an outer cylindrical surface and an inner cylindrical surface said coils being wound in said stator;

a tube for transporting the ferrofluid having magnetic particles suspended in a fluid, said tube being wound internal to and in close proximity to said inner cylindrical surface of said stator; and a power source of at least two phases and said power source being connected to said coils so as to produce a traveling magnetic field, whereby said traveling magnetic field moves said ferrofluid through said tube.

2. The pump is claim 1 further comprising:

a second cylindrical ferromagnetic stator, said first and second stators being spaced apart having an annular gap there between into which said tube resides.

3. A pump for a ferrofluid comprising:

at least a first group of coil elements forming at least two coils of electrical conductors, said coils being arranged in a cylindrical configuration;

a first ferromagnetic cylindrical stator having an outer cylindrical surface and an inner cylindrical surface said coils being contained in said stator;

a tube for transporting the ferrofluid having magnetic particles suspended in a fluid, said tube being wound external to and in close proximity to said outer cylindrical surface of said stator; and a power source of at least two phases and said power source being connected to said coils so as to produce a traveling magnetic field, whereby said traveling magnetic field moves said ferrofluid through said tube.

4. The pump of claim 3 further comprising:

a second cylindrical ferromagnetic stator, said first and second stators being spaced apart having an annular gap there between into which said tube resides.

5. The pump of claim 4 further comprising:

a second group of coil elements wound in said second stator, said coil elements being connected to said power source so as to produce a traveling magnetic field which reinforces the traveling magnetic field generated by said first group of coils.

* * * * *